US005399999A

United States Patent [19]

Eisenhart

[11] Patent Number: 5,399,999

[45] Date of Patent: Mar. 21, 1995

[54] WIDEBAND $TM_{01}$-TO-$TE_{11}$ CIRCULAR WAVEGUIDE MODE CONVERTOR

[75] Inventor: Robert L. Eisenhart, Woodland Hills, Calif.

[73] Assignee: Hughes Aircraft Company, Los Angeles, Calif.

[21] Appl. No.: 15,960

[22] Filed: Feb. 8, 1993

[51] Int. Cl.[6] ..... H01P 1/16; H01J 23/46

[52] U.S. Cl. ..... 333/21 R; 315/5; 315/5.38

[58] Field of Search ..... 333/21 R, 251; 315/4, 315/5, 5.38

[56] References Cited

U.S. PATENT DOCUMENTS

| | | | |
|---|---|---|---|
| 3,681,714 | 8/1972 | Terakawa | 333/21 R |
| 3,942,138 | 3/1976 | Schaedla | 333/21 R |
| 4,280,112 | 7/1981 | Eisenhart | 333/21 R |
| 4,282,458 | 8/1981 | Barnett | 333/251 X |
| 5,030.929 | 7/1991 | Moeller | 333/21 R |

FOREIGN PATENT DOCUMENTS

| | | | |
|---|---|---|---|
| 4137801 | 5/1992 | Japan | 333/251 |

OTHER PUBLICATIONS

"Development and High-Power Testing of a High Efficiency, Broadband $TM_{01}$-$TE_{11}$ Mode Convertor," C. David Cremer et al., Proceedings of the Fifth National Conference on High Power Microwave Technology, 10–15 Jun. 1990, pp. 284–287.

"Design of a single-period 8.6 GHz $TM_{01}$-$TM_{11}$ serpentine mode convertor and $TM_{01}$ and $TE_{11}$ bends in a moderately overmoded circular waveguide," G.H. Luo et al., Digest of the SPIE International Conference on Infrared and Millimeter Waves., Dec. 1990.

"Input Impedance of a Coaxial Line Probe Feeding a Circular Waveguide in the $TM_{01}$ Mode," R. H. MacPhie et al., IEEE Tran. Microwave Theory Tech., vol. MTT-38, pp. 334–337, Mar. 1990.

*Primary Examiner*—Benny T. Lee

*Attorney, Agent, or Firm*—Charles D. Brown; Randall M. Heald; Wanda K. Denson-Low

[57] ABSTRACT

The mode convertor employs two intermediate modes, a coaxial TEM and a rectangular waveguide $TE_{10}$ mode, in the transition between the $TM_{01}$ and $TE_{11}$ circular waveguide modes. The coaxial line provides isolation while acting as a mode filter between the device input and output ports. The rectangular waveguide provides a wide mode separation ratio between the $TE_{10}$ and $TM_{11}$ modes. The $TE_{10}$ mode then transitions into the $TE_{11}$ in the circular output waveguide. The coaxial section keeps the output $TE_{11}$ mode from scattering back to the input, and the rectangular section keeps the $TM_{01}$ from being excited in the output.

29 Claims, 3 Drawing Sheets

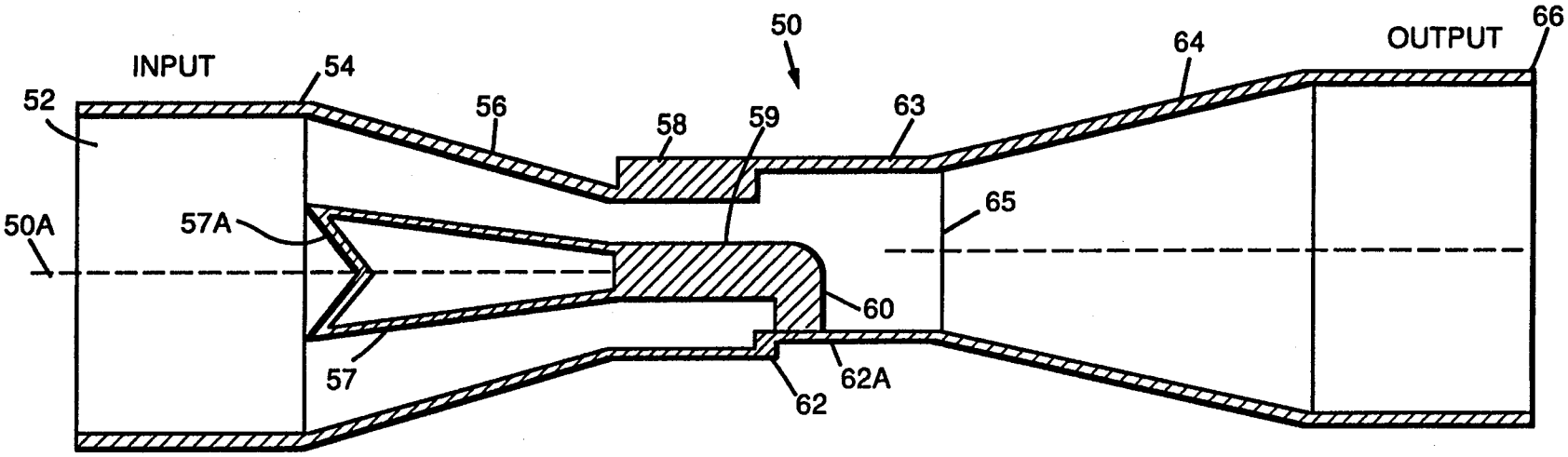
FIG. 2.
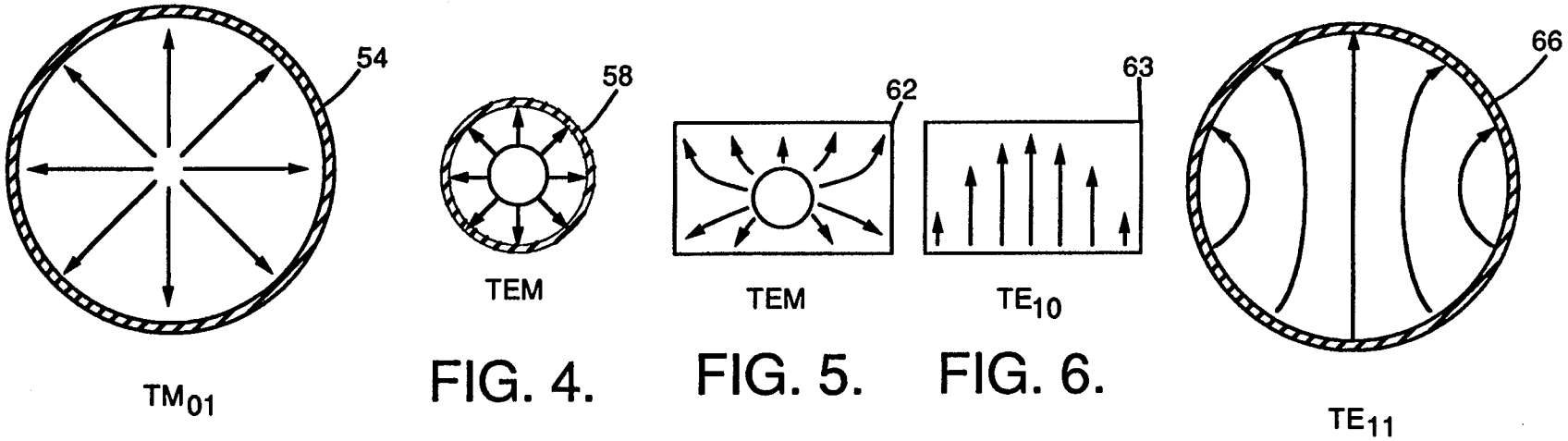
FIG. 7.
FIG. 6.
FIG. 5.
FIG. 4.
FIG. 3.

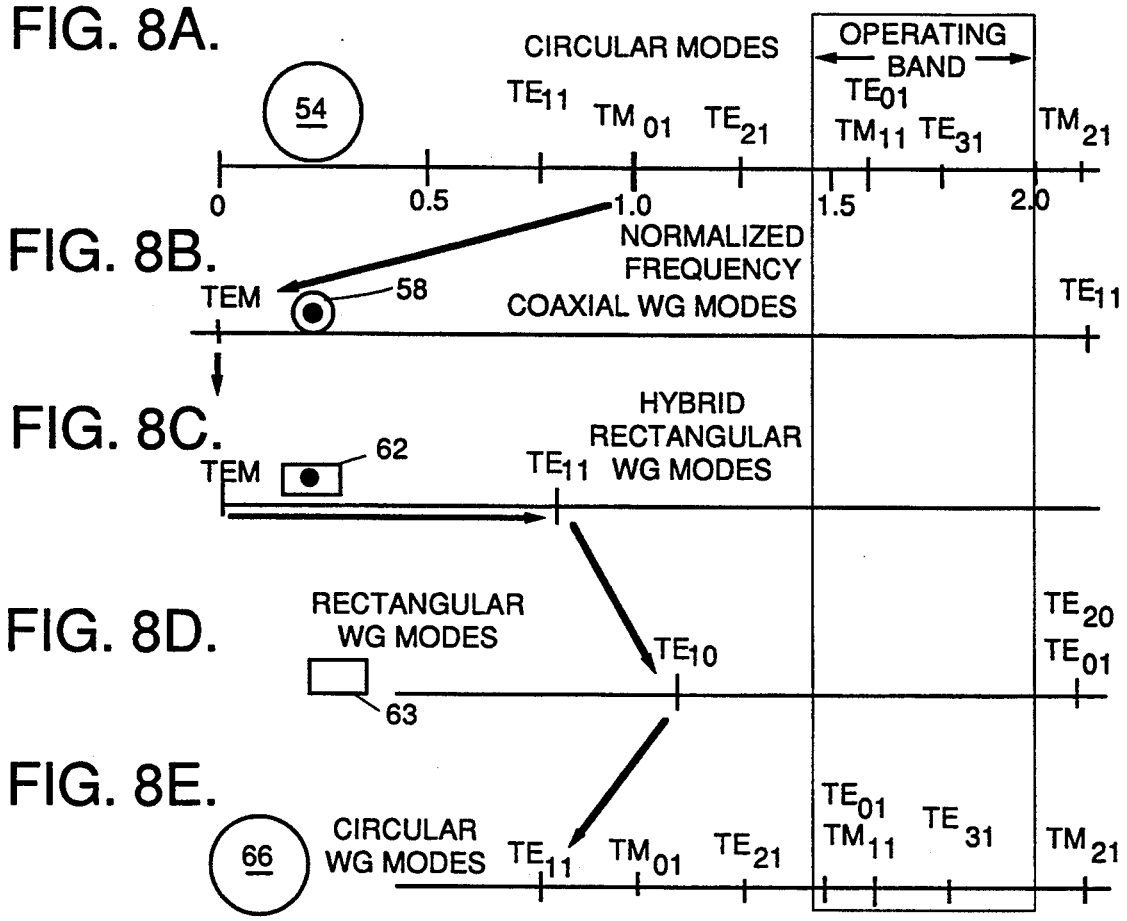
FIG. 8A.
CIRCULAR MODES
OPERATING BAND
54
TE11
TM 01
TE21
TE01
TM11
TE31
TM21
0
0.5
1.0
1.5
2.0
NORMALIZED FREQUENCY
FIG. 8B.
TEM
58
COAXIAL WG MODES
TE11
FIG. 8C.
HYBRID RECTANGULAR WG MODES
TEM
62
TE11
FIG. 8D.
RECTANGULAR WG MODES
TE10
TE20
TE01
63
FIG. 8E.
66
CIRCULAR WG MODES
TE11
TM01
TE21
TE01
TM11
TE 31
TM21
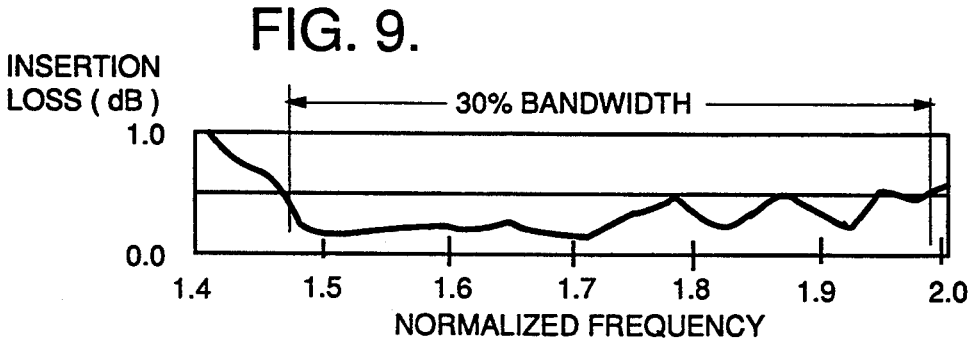
FIG. 9.
INSERTION LOSS ( dB )
30% BANDWIDTH
1.0
0.0
1.4
1.5
1.6
1.7
1.8
1.9
2.0
NORMALIZED FREQUENCY
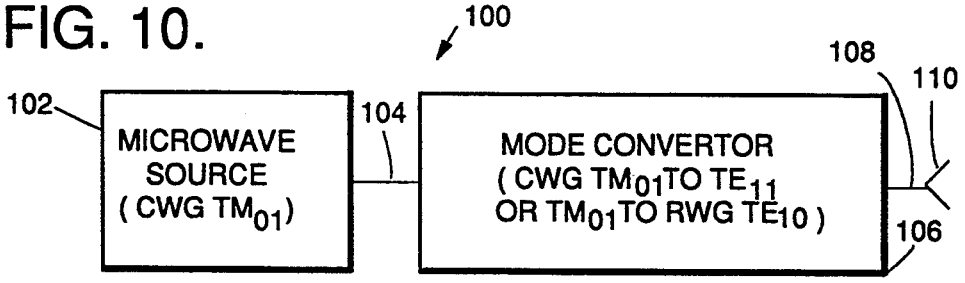
FIG. 10.
100
102
MICROWAVE SOURCE ( CWG TM01)
104
MODE CONVERTOR ( CWG TM01TO TE11 OR TM01TO RWG TE10 )
108
110
106

WIDEBAND $TM_{01}$-TO-$TE_{11}$ CIRCULAR WAVEGUIDE MODE CONVERTOR

BACKGROUND OF THE INVENTION

This invention is directed to an apparatus for converting between the $TM_{01}$ and $TE_{11}$ circular waveguide modes over a wide operating bandwidth.

The $TM_{01}$ mode is the mode often generated by high power microwave sources with axial electron beams, but its electric field distribution makes it difficult to use. In order to best use such sources, it is necessary to convert to the $TE_{11}$ mode.

One type of mode convertor, known as the "serpentine" mode convertor, is described in "Design of a single-period 8.6 GHz $TM_{01}$–$TM_{11}$ serpentine mode convertor and $TM_{01}$ and $TE_{11}$ bends in a moderately overmoded circular waveguide," G. H. Luo et al., Digest of the SPIE International Conference on Infrared and Millimeter Waves, Dec. 1990. This type of device converts the $TM_{01}$ mode to the $TE_{11}$ mode by a periodic series of bends in the circular waveguide. The serpentine design is very narrow band and relatively long (approximately 10 waveguide diameters). It also has no provision for collecting an electron beam if required.

A second type of mode convertor is a "tapered radial-fin" design as described in "Development and High-Power Testing of a High Efficiency, Broadband $TM_{01}$–$TE_{11}$ Mode Convertor," C. David Cremer et al., Proceedings of the Fifth National Conference on High Power Microwave Technology, 10–15 Jun. 1990, pp 284–287, and U.S. Pat. No. 4,999,591. This approach has wide bandwidth but at the expense of extensive extraneous mode contamination in both the input and output ports. This may be acceptable in some applications, however not in all, and particularly not where a uniform, high density radiation region is desired. This design can provide an extraneous-mode-free output over a smaller 12% bandwidth but the input port would always have extraneous modes. These extraneous modes act as energy absorbers creating a very irregular passband characteristic and reducing the conversion efficiency. The claimed efficiency averages about 70%.

It is therefore an object of the present invention to provide a well-matched, wideband, extraneous-mode-free mode conversion between the $TM_{01}$ and the $TE_{11}$ circular waveguide modes.

SUMMARY OF THE INVENTION

This invention provides a means of converting between the $TM_{01}$ and $TE_{11}$ circular waveguide modes over a wide operating bandwidth of extraneous-mode-free operation with low conversion loss. (Extraneous modes are the undesired modes.) A novel aspect of the invention is the use of two intermediate modes, a coaxial TEM and a rectangular waveguide $TE_{10}$. The coaxial line provides isolation while acting as a mode filter between the input and output ports, and the rectangular waveguide provides a wide mode separation ratio, necessary for bandwidth, between the $TE_{10}$ and $TM_{11}$ modes. The $TE_{10}$ then transitions into the $TE_{11}$ in a circular output waveguide. The significant result is that the coaxial section keeps the output $TE_{11}$ mode from scattering back to the input, and the rectangular section keeps the $TM_{01}$ mode from being excited in the output.

BRIEF DESCRIPTION OF THE DRAWING

These and other features and advantages of the present invention will become more apparent from the following detailed description of an exemplary embodiment thereof, as illustrated in the accompanying drawings, in which:

FIG. 2 is a lengthwise cross-section of the mode convertor of FIG. 1, taken along line 2—2 of FIG. 1.

FIGS. 3, 4, 5, 6 and 7 are cross-sections of the mode convertor of FIG. 1, taken along respective lines 3—3, 4—4, 5—5, 6—6 and 7—7 of FIG. 1.

FIGS. 8A–8E are schematic illustrations of the mode cutoff frequency distribution as a function of frequency in various waveguides, specifically circular, coaxial, hybrid rectangular, rectangular and circular.

FIG. 9 is a plot of insertion loss as a function of normalized frequency for the mode convertor of FIG. 1.

FIG. 10 illustrates an exemplary microwave transmission system employing a mode convertor in accordance with this invention.

DETAILED DESCRIPTION OF THE PREFERRED EMBODIMENT

Figure 1:
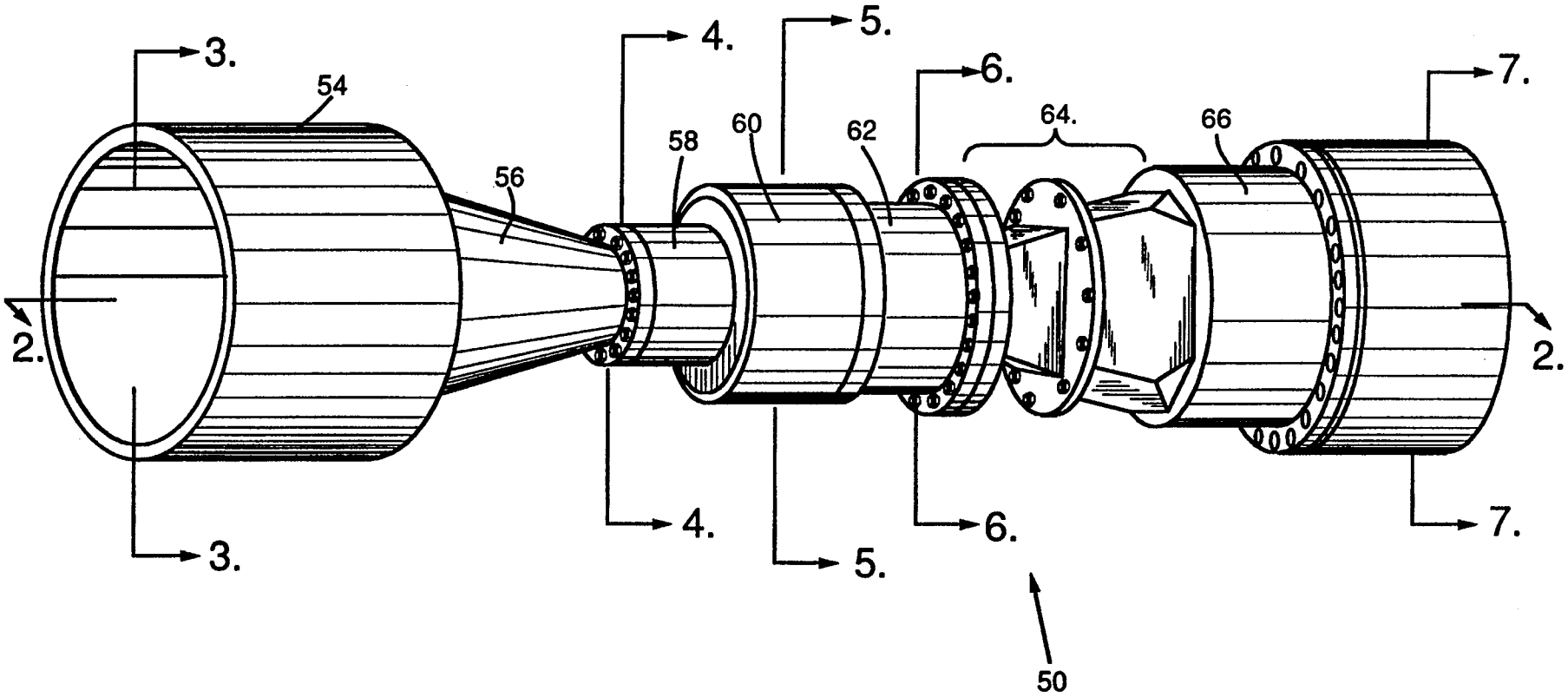
FIG. 1 is a perspective view of a mode convertor embodying the present invention.

A perspective view of a convertor 50 embodying the invention is shown in FIG. 1, and showing exemplary INPUT and OUTPUT ends. A lengthwise cross-section of the convertor 50, taken along line 2—2 of FIG. 1, is shown in FIG. 2. As seen in FIG. 2, assume that a $TM_{01}$ circular waveguide (CWG) mode is incident from the left at the input port 52. The energy is first transitioned via circular waveguide section 54 into a coaxial section 56 that tapers to a smaller diameter. A length of straight coaxial section 58 at this diameter with center conductor 59 feeds a bend 60 in the center conductor 59 which functions as an excitation loop 60 in the rectangular waveguide (RWG) 62. A short section 63 of this RWG then feeds into a smooth tapered RWG transition 64 out to the circular waveguide output 66. At the interface with the circular waveguide 66, the RWG 64 dimensions have a 2:1 width to height aspect, with the width dimension being slightly less than the circular waveguide diameter.

The straight coaxial section 58 blocks the $TE_{11}$ mode that is excited in the RWG 62 from coupling back to the input 52. The mode convertor 50 comprises a means for converting the input $TM_{01}$ mode energy component into the coaxial TEM mode, a means for converting the TEM mode into the rectangular $TE_{10}$ mode, and, in this exemplary embodiment, means for converting the rectangular $TE_{10}$ mode energy into the circular waveguide $TE_{11}$ mode. For many applications, the output may be taken directly from the $TE_{10}$ mode energy, so that the mode conversion from the rectangular $TE_{10}$ mode into the circular waveguide $TE_{11}$ mode may be omitted. Unless it is specifically desired to convert to the $TE_{11}$ CWG, it would be more convenient to use the $TE_{10}$ RWG as the output port. This is due to the availability of components in RWG for transmission and control of the energy; moreover, the $TE_{10}$ mode is more easily kept separate from higher order modes than the $TE_{11}$. Conversion to the $TE_{11}$ in the embodiment of FIG. 1 was done to have similar input and output ports so that the system in which the convertor is employed could be used when the mode convertor is removed. In other words, the mode convertor is an insertable/removable component. Thus, in its most general sense, the invention contemplates that the output tapered rectangular waveguide section 64 and output circular waveguide section would not be necessary.

The means for converting the input $TM_{01}$ mode energy into the coaxial mode energy comprises the tapered coaxial section 56, which communicates at its input end with the input circular waveguide section 52, and the straight coaxial section 58. This section of the mode convertor 50 is more fully described in copending application Ser. No. 07/984,398, filed Dec. 2, 1992, entitled "WIDEBAND COAX-TO-$TM_{01}$ CONVERTOR," by the present applicant and commonly assigned with the present application. The copending application is incorporated herein in its entirety.

The tapered coaxial line 56 comprises a tapered hollow outer conductor 56 and a tapered hollow inner conductor 57. A molybdenum cap 57A is inserted into the end of the conductor 57, and has an inverted conical shape. The cap 57A can serve as an electron beam collector for electrons emitted along the convertor axis 50A by, e.g., a high power RF amplifier connected at the input 52 to the convertor 50. The inner conductor 57 is hollow in order to reduce the weight of the conductor 57 and the resulting moment force applied on conductor 59. The cap 57A has no influence on the RF signals, since the electric fields do not enter the depression formed by the inverted conical cap.

The means for converting the coaxial TEM mode energy into the rectangular $TE_{10}$ mode comprises the hybrid RWG section 62, which is a section with rectangular outer conductor and circular inner conductor. The bend 60 in the center conductor 59 is in this RWG section 63.

The means for converting the rectangular $TE_{10}$ mode energy into the circular waveguide $TE_{11}$ mode comprises the tapered rectangular waveguide section 64, which transitions to the circular waveguide 66.

FIGS. 3, 4, 5, 6 and 7 illustrate widthwise cross-section views of the mode convertor 50, taken along lines 3—3, 4—4, 5—5, 6—6 and 7—7 of FIG. 1, respectively. The electric field patterns are displayed in FIGS. 3, 4, 5, 6 and 7 for the appropriate modes in each type of waveguide used. FIG. 3 illustrates the input circular waveguide 54 with the incident $TM_{01}$ mode. FIG. 4 illustrates the coaxial section 58 with the TEM mode. FIG. 5 illustrates the hybrid rectangular waveguide 62 with the TEM mode. FIG. 6 illustrates the rectangular waveguide section 63 and the $TE_{10}$ mode. FIG. 7 illustrates the circular waveguide 66 and the $TE_{11}$ mode.

A more detailed description of the significance of the intermediate modes can be given by considering FIGS. 8A–8E, which respectively relate the waveguide cross-section to the mode cutoff frequencies for that waveguide. FIG. 8A illustrates the input circular waveguide 54 with the incident $TM_{01}$ mode, and shows the cutoff frequencies for all the various higher order modes of that waveguide, including the $TE_{21}$, $TE_{01}$, $TM_{11}$ and $TE_{31}$ modes, up to the first mode ($TM_{21}$) which is above the desired operating band. These cutoff frequencies represent the lower end of the range where that particular mode can propagate in the waveguide of that size. The scale below the horizontal line (FIG. 8A) shows the frequency spread, normalized to the cutoff of the mode of interest, the $TM_{01}$. The significance of this is that five (5) other modes can exist in waveguide 54 if excited.

To convert from the $TM_{01}$ to the $TE_{11}$ directly would also excite the $TE_{21}$, $TM_{11}$ and the $TE_{31}$ as well as the $TE_{11}$, and they would be reflected back into the input waveguide 54. (The $TE_{01}$ would not likely be excited because it has no radial electric fields.) These would be the extraneous modes, absorbing energy and in general creating poor performance. All of these modes can be avoided by converting to the TEM mode that maintains the same circumferential and similar radial symmetries as the $TM_{01}$ mode. The next higher mode that would be excited by this means is the $TM_{02}$ mode but it has a cutoff frequency of three times the $TM_{01}$, or well above the band of interest.

The TEM region begins in the convertor 50 in the coaxial section 56 at the same diameter as waveguide 54. The section 56 is then tapered slowly down (to maintain a good impedance match) to the smaller diameter of straight coaxial section 58. (See FIG. 8B, illustrating the coaxial waveguide modes, the TEM and $TE_{11}$.) The smaller diameter is necessary to push the $TE_{11}$ coaxial mode band above the operating band and can now act as a block to the $TE_{11}$ mode once it is excited in the rectangular waveguide 62. The isolations (Iso(dB)) available is determined by a) the ratio of the upper limit of the operating band to the $TE_{11}$ cutoff frequency in the coaxial line, b) the diameter of the section 58, and c) the length of the section 58. The relationship Iso(dB) is:

$$Iso(dB)=24.7\ (lenc/d)(1-r_c^2)^{\frac{1}{2}}$$

where $r_c$=frequency ratio d=coaxial section 58 diameter lenc=coaxial section 58 length.

The energy then propagates along the center conductor 59 into the hybrid rectangular waveguide 62. The hybrid rectangular waveguide 62 will support a TEM mode in addition to the normal rectangular waveguide modes because of the presence of the inner conductor 59. (See FIG. 8C, illustrating the TEM and $TE_{11}$ waveguide modes of the hybrid rectangular waveguide 62.) The hybrid rectangular waveguide has the same outer dimensions as the rectangular waveguide 63, with an inner conductor of the same diameter as the center conductor of coaxial line 58. The outer conductor 58 changes abruptly into the rectangular waveguide as a hole in the end wall of the rectangular waveguide. The hole is centered side-to-side and slightly below center from top-to-bottom. Since the outer diameter is almost as large as the waveguide height, the offset downward results in a step at the transition plane. The center line of the inner conductor extends approximately one "inner conductor diameter" in to the hybrid waveguide section. Also the height of the center line of the inner conductor is approximately one "inner conductor diameter" above the waveguide bottom wall 62A (see FIG. 2). The corner or knee shape of the inner conductor at the bend 60 is spherical at the junction of the horizontal and vertical sections. This maximizes the radius of curvature to minimize the surface electric field for any given power level in the convertor. (FIG. 8C) As long as the center conductor 59 is on axis, the mode is still TEM.

At the bend 60 where the center conductor 59 shorts to the bottom wall 62A of the waveguide 62, the $TE_{11}$ coaxial mode is excited along with the $TE_{10}$ mode. The $TE_{10}$ propagates in the open rectangular waveguide section 63 to the right of the bend, and the $TE_{11}$ mode is reflected back into the hybrid section. This coaxial $TE_{11}$ mode cannot continue into the smaller diameter coaxial section and is trapped between the small coaxial section 58 and the bend 60. Proper dimensioning in this region provides a broadband match between the incident TEM and the launched $TE_{10}$ of the rectangular waveguide 63 (see FIG. 8D, showing the propagation cutoffs of the rectangular waveguide modes $TE_{10}$, $TE_{20}$ and $TE_{01}$). The dimensions selected can be determined through a iterative modeling and measurement process to optimize the bandwidth. Rectangular waveguide is used at this point because the reduced height of the rectangular waveguide forces the cutoff frequencies of the higher modes above the operating band. A particular concern is the $TM_{11}$ in the rectangular guide that corresponds to the $TM_{01}$ in circular guide. The propagation cutoff of the $TM_{11}$ is 2.24 times above the $TE_{10}$ cutoff (off the scale). The $TM_{11}$ is, however, still excited by the bent center conductor 59, but, not being able to propagate, is reactively attenuated within the rectangular waveguide 63 according to the following relationship:

$$Iso(dB)=60.8\ (lenr/a)(1-r_r^2)^{\frac{1}{2}}$$

where $r_r$=frequency ratio a=rectangular section width lenr=rectangular section length from the bend to the output.

Therefore, only the $TE_{10}$ propagates to the output end 65 (see FIG. 2) of the rectangular waveguide 63. A smooth transition to the full size circular waveguide 66 and the corresponding $TE_{11}$ mode avoids exciting the many modes that could exist if such care were not taken (see FIG. 8E, showing the circular waveguide modes $TE_{11}$, $TM_{01}$, $TE_{21}$, $TE_{01}$, $TM_{11}$, $TE_{31}$ and $TM_{21}$).

If the center conductor bend 60 had been placed directly in the output circular waveguide 66, leaving out the rectangular sections 62 and 63, the $TE_{11}$ could have been excited; however, the operating band would be restricted to about 12% if avoidance of the higher order modes is desired.

Assuming the requirements of bandwidth, mode purity, and conversion efficiency, it is also desired to maximize the power level through the convertor. This is limited by the coaxial section 58 and the "knee" of the bend 60 which would have the highest field concentration. Larger coaxial section inner and outer diameters allow higher power. Therefore, the largest diameter possible consistent with the mode isolation requirement is preferably used for this section. (The $TE_{11}$ cutoff frequency in the coaxial section is inversely proportional to the diameter.)

FIG. 9 shows the insertion loss data as a function of normalized frequency, as measured for convertor 50 on an automatic network analyzer. As shown in FIG. 9, the convertor 50 has an approximate 30% bandwidth. The frequency scale is normalized to the $TM_{01}$ cutoff frequency of the circular waveguide. This measurement was fully calibrated with proper mode launchers on each end.

FIG. 10 illustrates an exemplary microwave radiation system 100 embodying a mode convertor in accordance with the invention. A microwave source 102 generates the CWG TM01 mode energy, and is typically a high power source. The output of the source 102 is connected to a mode convertor 106 via a CWG 104. The output of the mode convertor 106 is, for example, connected to a radiating horn 110 by a waveguide 108. The mode convertor 106 can either convert the CWG TM01 mode energy to the CWG $TE_{11}$ mode, or to the RWG $TE_{10}$ mode. In the former case, a mode convertor as shown in FIGS. 1 and 2 can be employed, and the waveguide 108 will be a CWG section. If the application is to employ an output radiation pattern generated by RWG $TE_{10}$ mode energy, then the last conversion stage of the convertor 50 will be omitted, i.e., the tapered RWG 64 and CWG section 66 will be omitted, and the waveguide 108 will be RWG.

The mode convertor in accordance with this invention provides a number of advantages including the following.

1. The mode convertor has excellent bandwidth showing high conversion efficiency (>94% for >30% frequency band or >97% for >20% band). Previously available approaches are narrow band.
2. The mode convertor maintains mode purity of the $TM_{01}$ mode on one side and $TE_{11}$ mode purity on the other. Previously available wideband approaches are contaminated with higher order modes reflected back at the input ($TM_{01}$) side. Even narrow band approaches tend to scatter the $TE_{11}$ mode on the input.
3. The convertor maintains axial alignment of the $TM_{01}$ and $TE_{11}$ waveguides (often important in system layouts). Previously available approaches often require orthogonal axes for the two sides.
4. The convertor can use the center conductor of the $TM_{01}$ side as a beam collector if desired. This is because the center conductor has a relatively large on-axis cross-section and is also grounded to the sidewall. This feature is convenient because the on-axis electron beam devices are the ones which generate the $TM_{01}$ mode.
5. The convertor is relatively short on axis (about four waveguide diameters). Some conventional convertors are much longer.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A mode convertor for converting between the circular waveguide $TM_{01}$ mode and the rectangular waveguide $TE_{10}$ mode, comprising:

an input port receiving electromagnetic energy having a circular waveguide $TM_{01}$ mode energy component;

first converting means communicating with said input port for converting said $TM_{01}$ energy component to a coaxial TEM mode energy component; and second converting means communicating with said first converting means for converting said coaxial TEM mode energy component into a rectangular waveguide $TE_{10}$ mode energy component.

2. The mode convertor of claim 1 wherein said input port is coupled to a circular waveguide section having a given diameter, and said first converting means comprises:

a tapered coaxial transmission line having first and second ends, comprising a hollow outer conductor having a diameter which tapers from said circular waveguide diameter at said first end to a coaxial line outer conductor diameter at said second end which is smaller than said circular waveguide diameter, and a tapered inner conductor disposed within said hollow outer conductor, a diameter of said inner conductor tapering from a first diameter at said first end to a second diameter at said second end; and a straight coaxial line segment connecting with said second end of said tapered coaxial line, said straight coaxial segment comprising an outer conductor connected to said coaxial line outer conductor and having a diameter substantially equal to said coaxial line outer conductor diameter, and an inner conductor having a diameter equal to said second diameter and connected to said inner conductor of said tapered coaxial line.

3. The mode convertor of claim 2 wherein said second converting means comprises a rectangular waveguide section connected to said straight coaxial line segment, said inner conductor of said straight coaxial line segment extending into said rectangular waveguide and having a bend defined therein, so that an end of said coaxial center conductor is disposed adjacent to and in electrical contact with a sidewall of said rectangular waveguide, thereby providing an excitation loop disposed in said rectangular waveguide to excite said $TE_{10}$ mode energy component.

4. The mode convertor of claim 2 further comprising an electron beam collector operatively coupled to said first converting means, said collector for receiving electrons directed into said input port.

5. The mode convertor of claim 2 further comprising an electron beam collector comprising a depression defined in said inner conductor at said first end.

6. The mode convertor of claim 5 wherein said depression is defined by a molybdenum surface at said first end of said inner conductor.

7. The mode convertor of claim 1 wherein said second converting means comprises a rectangular waveguide section having an excitation loop disposed therein and operatively coupled to said rectangular waveguide section to excite said $TE_{10}$ mode energy component.

8. The mode convertor of claim 1 further comprising an output port at an output of said second converting means, said input port having an input port axis, said output port having an output port axis, and wherein said input and output port axes are in general alignment with each other.

9. Apparatus for converting between the circular waveguide $TM_{01}$ and $TE_{11}$ modes, comprising:

an input port receiving electromagnetic radiation having a circular waveguide $TM_{01}$ mode energy component;

first converting means communicating with said input port for converting said $TM_{01}$ energy component to a coaxial TEM mode energy component;

second converting means communicating with said first converting means for converting said coaxial TEM mode energy component into a rectangular waveguide $TE_{10}$ mode energy component; and third converting means communicating with said second converting means for converting said rectangular waveguide $TE_{10}$ mode energy component into said circular waveguide $TE_{11}$ mode.

10. The mode convertor of claim 9 further comprising an output port at an output of said third converting means, said input port having an input port axis, said output port having an output port axis, and wherein said input and output port axes are in general alignment with each other.

11. The mode convertor of claim 9 further comprising an electron beam collector operatively coupled to said first converting means, said collector for receiving electrons directed into said input port.

12. The mode convertor of claim 9 further comprising an electron beam collector for receiving electrons directed into said input port, said electron beam collector comprising a depression defined in said inner conductor at said first end.

13. The mode convertor of claim 12 wherein said depression is defined by a molybdenum surface at said first end of said inner conductor.

14. The apparatus of claim 9 wherein said second converting means comprises a rectangular waveguide section having an excitation loop disposed therein and operatively coupled to said rectangular waveguide section to excite said $TE_{10}$ mode energy component.

15. The apparatus of claim 9 wherein said third converting means comprises a tapered rectangular waveguide section which transitions to an output port.

16. The apparatus of claim 9 wherein said input port is coupled to a circular waveguide having a given diameter, and said first converting means comprises:

a tapered coaxial transmission line having first and second ends, comprising a hollow outer conductor having a diameter which tapers from said circular waveguide diameter at said first end to a coaxial line outer conductor diameter at said second end which is smaller than said circular waveguide diameter, and a tapered inner conductor disposed within said hollow outer conductor, a diameter of said inner conductor tapering from a first diameter at said first end to a second diameter at said second end; and a straight coaxial line segment connecting with said second end of said tapered coaxial line, said straight coaxial segment comprising an outer conductor having a diameter substantially equal to said coaxial line outer conductor diameter and an inner conductor having a diameter equal to said second diameter.

17. The mode convertor of claim 16 wherein said second converting means comprises a rectangular waveguide section connected to said straight coaxial line segment, said inner conductor of said straight coaxial line segment extending into said rectangular waveguide and having a bend defined therein, so that an end of said coaxial center conductor is disposed adjacent to and in electrical contact with a sidewall of said rectangular waveguide, thereby providing an excitation loop disposed in said rectangular waveguide to excite said $TE_{10}$ mode energy component.

18. A system for radiating electromagnetic energy, comprising:

a source of electromagnetic energy providing circular waveguide $TM_{01}$ mode signals;

a radiating element for radiating electromagnetic energy in response to rectangular waveguide $TE_{10}$ mode excitation signals; and a mode convertor coupling said energy source to said radiating element and for converting said circular waveguide $TM_{01}$ mode signals to said rectangular waveguide $TE_{10}$ mode signals, said mode convertor comprising:

an input port receiving said circular waveguide $TM_{01}$ signals;

first converting means communicating with said input port for converting said $TM_{01}$ mode signals into coaxial TEM mode signals; and second converting means communicating with said first converting means for converting said coaxial TEM mode signals into said rectangular waveguide $TE_{10}$ mode signals.

19. The mode convertor of claim 18 further comprising an electron beam collector operatively coupled to said first converting means, said collector for receiving electrons directed into said input port.

20. The mode convertor of claim 18 further comprising an output port at an output of said second converting means, said input port having an input port axis, said output port having an output port axis, and wherein said input and output port axes are in general alignment with each other.

21. The mode convertor of claim 18 wherein said input port is coupled to a circular waveguide section having a given diameter, and said first converting means comprises:

a tapered coaxial transmission line having first and second ends, comprising a hollow outer conductor having a diameter which tapers from said circular waveguide diameter at said first end to a coaxial line outer conductor diameter at said second end which is smaller than said circular waveguide diameter, and a tapered inner conductor disposed within said hollow outer conductor, a diameter of said inner conductor tapering from a first diameter at said first end to a second diameter at said second end; and a straight coaxial line segment connecting with said second end of said tapered coaxial line, said straight coaxial segment comprising an outer conductor connected to said coaxial line outer conductor and having a diameter substantially equal to said coaxial line outer conductor diameter, and an inner conductor connected to said coaxial line inner conductor and having a diameter equal to said second diameter.

22. The mode convertor of claim 21 wherein said second converting means comprises a rectangular waveguide section connected to said straight coaxial line segment, said inner conductor of said straight coaxial line segment extending into said rectangular waveguide and having a bend defined therein, so that an end of said coaxial center conductor is disposed adjacent to and in electrical contact with a sidewall of said rectangular waveguide, thereby providing an excitation loop disposed in said rectangular waveguide to excite said $TE_{10}$ mode energy component.

23. The mode convertor of claim 21 further comprising an electron beam collector for receiving electrons directed into said input port, said electron beam collector comprising a depression defined in said inner conductor at said first end.

24. A system for radiating electromagnetic energy, comprising:

a source of electromagnetic energy providing circular waveguide $TM_{01}$ mode signals;

a radiating element for radiating electromagnetic energy in response to circular waveguide $TE_{11}$ mode excitation signals; and a mode convertor coupling said energy source to said radiating element and for converting said circular waveguide $TM_{01}$ mode signals to circular waveguide $TE_{11}$ mode signals, said convertor comprising:

an input port receiving said circular waveguide $TM_{01}$ signals;

first converting means communicating with said input port for converting said $TM_{01}$ mode signals into coaxial TEM mode signals;

second converting means communicating with said first converting means for converting said coaxial TEM mode signals into rectangular waveguide $TE_{10}$ mode signals; and third converting means communicating with said second converting means for converting said rectangular waveguide $TE_{10}$ mode signals into said circular waveguide $TE_{11}$ mode signals.

25. The mode convertor of claim 24 further comprising an electron beam collector operatively coupled to said first converting means, said collector for receiving electrons directed into said input port.

26. The mode convertor of claim 24 wherein said input port is coupled to a circular waveguide section having a given diameter, and said first converting means comprises:

a tapered coaxial transmission line having first and second ends, comprising a hollow outer conductor having a diameter which tapers from said circular waveguide diameter at said first end to a coaxial line outer conductor diameter at said second end which is smaller than said circular waveguide diameter, and a tapered inner conductor disposed within said hollow outer conductor, a diameter of said inner conductor tapering from a first diameter at said first end to a second diameter at said second end; and a straight coaxial line segment connecting with said second end of said tapered coaxial line, said straight coaxial segment comprising an outer conductor connected to said coaxial line outer conductor and having a diameter substantially equal to said coaxial line outer conductor diameter and an inner conductor connected to said coaxial line inner conductor and having a diameter equal to said second diameter.

27. The mode convertor of claim 26 further comprising an electron beam collector for receiving electrons directed into said input port, said electron beam collector comprising a depression defined in said inner conductor at said first end.

28. The mode convertor of claim 26 wherein said second converting means comprises a rectangular waveguide section connected to said straight coaxial line segment, said inner conductor of said straight coaxial line segment extending into said rectangular waveguide and having a bend defined therein, so that an end of said coaxial center conductor is disposed adjacent to and in electrical contact with a sidewall of said rectangular waveguide, thereby providing an excitation loop disposed in said rectangular waveguide to excite said $TE_{10}$ mode energy component.

29. The mode convertor of claim 24 further comprising an output port at an output of said third converting means, said input port having an input port axis, said output port having an output port axis, and wherein said input and output port are in general alignment with each other.

* * * * *